US005788475A

United States Patent [19]

Henderson

[11] Patent Number: 5,788,475

[45] Date of Patent: Aug. 4, 1998

[54] ALUMINUM SCUBA TANK BUOYANCY COMPENSATION SYSTEM

[76] Inventor: Mark Henderson, 28104-8 Bobwhite Cir., Saugus, Calif. 91350

[21] Appl. No.: 740,931

[22] Filed: Nov. 5, 1996

[51] Int. Cl.[6] ..... B63C 11/22; B63C 11/02

[52] U.S. Cl. ..... 405/186; 405/185; 441/108

[58] Field of Search ..... 405/185, 186; 248/311.2, 910; 441/86, 108

[56] References Cited

U.S. PATENT DOCUMENTS

| | | | |
|---|---|---|---|
| 3,964,266 | 6/1976 | Bartlett | 405/186 |
| 3,967,459 | 7/1976 | Denis . | |
| 4,455,718 | 6/1984 | Finnern | 405/186 |
| 5,199,820 | 4/1993 | Nicklo | 405/186 |
| 5,221,161 | 6/1993 | Toy | 405/186 |
| 5,267,815 | 12/1993 | Feder | 405/186 |
| 5,273,182 | 12/1993 | Laybourne | 248/310 X |
| 5,489,043 | 2/1996 | Newman | 248/910 X |

*Primary Examiner*—Dennis L. Taylor
*Attorney, Agent, or Firm*—Goldstein & Associates

[57] ABSTRACT

An aluminum tank buoyancy compensation system, for use with aluminum tanks having a flat bottom, a diameter and a boot attached at the flat bottom, for offsetting the inherent positive buoyancy of an empty aluminum scuba tank, comprising a weight disk having substantially the same diameter as the tank bottom. The weight disk is inserted into the boot, and the boot is replaced onto the bottom of the tank. The weight disk is trapped between the boot and tank bottom, ballasting the tank sufficiently to compensate for the positive buoyancy of the aluminum tank.

6 Claims, 2 Drawing Sheets

ALUMINUM SCUBA TANK BUOYANCY COMPENSATION SYSTEM

BACKGROUND OF THE INVENTION

The invention relates to a aluminum scuba tank buoyancy compensation system. More particularly, the invention relates to a system for allowing an aluminum tank to be used in place of a standard steel tank by compensating for the greater inherent buoyancy of the aluminum tank.

A typical scuba tank is cylindrical in shape, made from either steel or aluminum, and has a valve assembly at the top of the cylinder. A protective boot is attached at the bottom of the tank, which is generally made of plastic or rubber, and is easily removable. According to Department of Transportation regulations, a scuba tank must be visually inspected annually, and must be hydrostatically tested every five years. When the hydrostatic test is performed, the boot is removed.

The great majority of conventional scuba tanks are made of steel. Steel tanks have several drawbacks. First, they have a tendency to corrode. Second, they weigh more than comparable aluminum tanks, making them more difficult to handle out of the water.

Aluminum tanks cost considerably less than steel tanks, require less maintenance, and are easier to handle on land. However, because aluminum is less dense than steel, an aluminum tank becomes positively buoyant as it empties. This inherent buoyancy can be problematic to the scuba diver, who wishes to have an overall negative buoyancy when his BC (buoyancy compensation) vest is empty. This drawback is the single greatest reason why steel tanks have dominated over aluminum.

A system such as the weight strap disclosed in U.S. Pat. No. 4,455,718 to Finnern might be used to compensate for the otherwise positive buoyancy of the tank. However, Department of Transportation regulations prohibit attaching any external devices to the tank, other than the boot. Thus, the attachment of any weight to the tank is illegal.

While these units may be suitable for the particular purpose employed, or for general use, they would not be as suitable for the purposes of the present invention as disclosed hereafter.

SUMMARY OF THE INVENTION

It is an object of the invention to produce a system for compensating for the inherent positive buoyancy of an empty or near empty aluminum tank.

It is another object of the invention to provide a weight disk which makes the tank neutrally or negatively buoyant.

It is a further object of the invention that the weight disk is mounted between the tank and boot so that in essence it is never actually attached to the tank, thus complying with Department of Transportation regulations.

It is a still further object of the invention that the weight is permanently attached in the boot.

The invention is an aluminum tank buoyancy compensation system, for use with aluminum tanks having a flat bottom, a diameter and a boot attached at the flat bottom, for offsetting the inherent positive buoyancy of an empty aluminum scuba tank, comprising a weight disk having substantially the same diameter as the tank bottom. The weight disk is inserted into the boot, and the boot is replaced onto the bottom of the tank. The weight disk is trapped between the boot and tank bottom, ballasting the tank sufficiently to compensate for the positive buoyancy of the aluminum tank.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
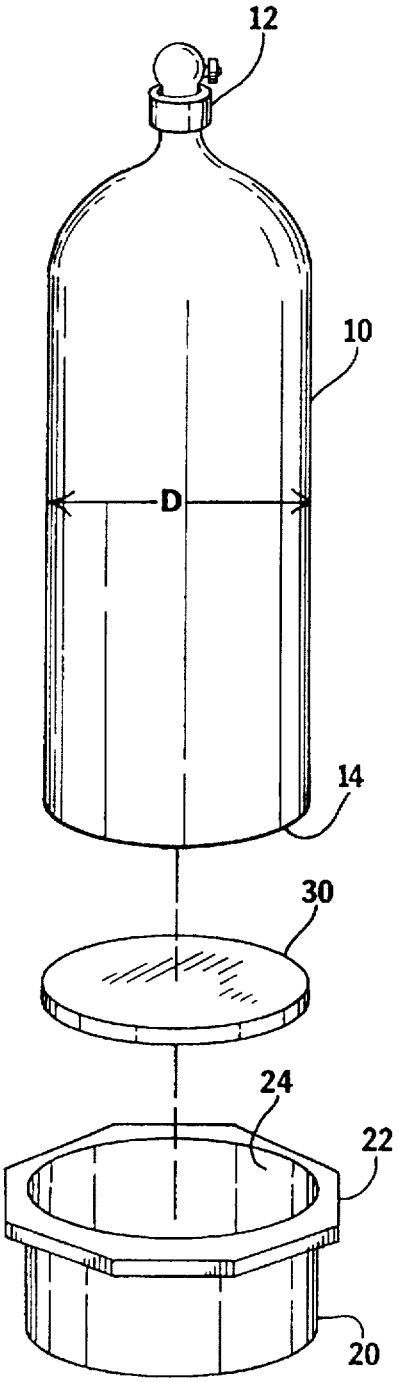
FIG. 1 is an exploded perspective view of the scuba tank, the weight disk, and the boot, according to the present invention.

FIG. 1 illustrates an aluminum scuba tank 10. The scuba tank 10 is cylindrical, having a valve assembly 12 on one end, and a flat bottom 14 opposite the valve assembly 12. The scuba tank 10 has a diameter D, which is fairly consistent over the length of the cylinder, and is the diameter of the flat bottom 14.

Figure 3:
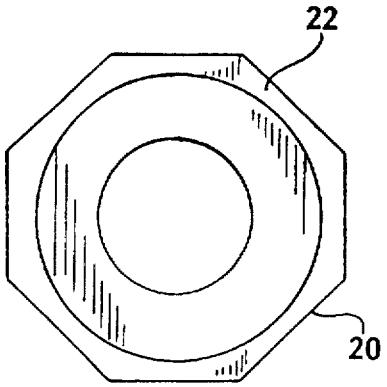
FIG. 3 is a top plan view of just the boot.

Also illustrated in FIG. 1 is a boot 20. The boot is made of plastic or rubber. Referring to FIG. 3, the boot 20 has a bumper flange 22 extending outward, and has an inner bore 24 of approximately the same diameter as the scuba tank 10. The tank 10 is inserted into the boot 20, and the boot provides protection for the scuba tank. The bumper flange 22 allows similar tanks to be placed side by side, without the tanks actually touching each other.

Figure 2:
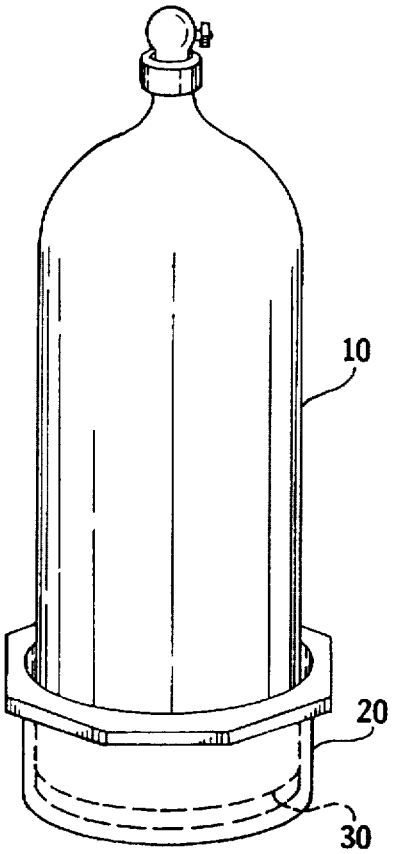
FIG. 2 is a diagrammatic perspective view of the assembled invention.

According to the present invention, a weight disk 30 is provided which is substantially the same diameter as the cylindrical tank 10 including the flat bottom, and as the inner bore. The weight disk 20 is placed in the inner bore 24 of the boot, prior to placing the tank in the inner bore of the boot. Once the tank is inserted into the boot 20, as illustrated in FIG. 2, the weight disk 30 is essentially trapped between the boot 20 and the tank 10, but is never actually attached to the tank 10.

The weight disk 30 is preferably made of lead, and its thickness is selected to provide sufficient weight to ballast the tank to compensate for the positive buoyancy force of the scuba tank 10 with which it is used. Typically the weight disk 30 will be between 1/32" and 1/4" in thickness.

Figure 4:
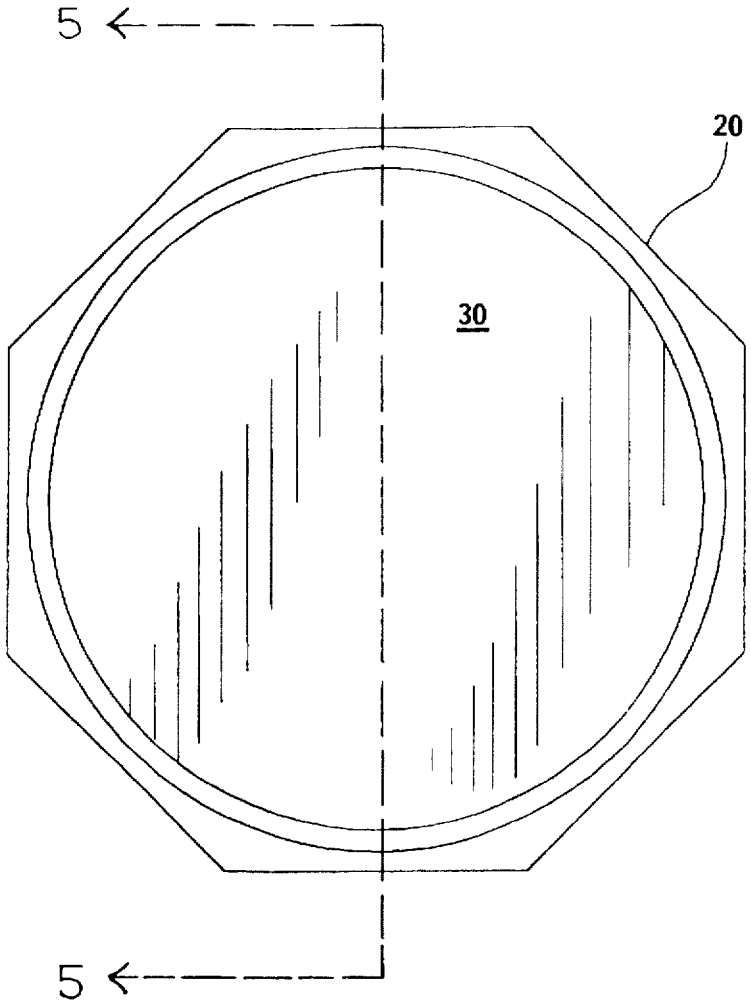
FIG. 4 is a top plan view of a second embodiment of the invention.
Figure 5:
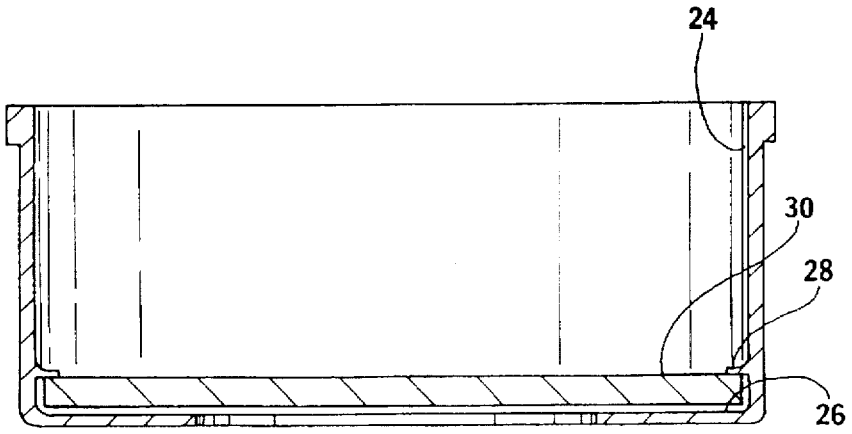
FIG. 5 is a cross sectional view, taken along line 5—5 in FIG. 4.

FIG. 4 illustrates a further embodiment of the invention, in which the weight disk 30 is an integral part of the boot 20. Referring to FIG. 5, the boot 20 has a boot bottom 26, which would normally provide support for the flat bottom 14 of the tank 10. However, according to the second embodiment of the invention, the weight disk 30 is mounted against the boot bottom 26, and is held in place by an inner lip 28 extending inward from the inner bore 24 just above the boot bottom 26, trapping the weight disk 30 against the boot bottom 26.

In conclusion, herein is presented a system for effectively ballasting an aluminum tank, compensating for the tendency for the tank to become positively buoyant, while complying with Department of Transportation regulations.

What is claimed is:

1. An aluminum tank buoyancy compensation method, using an aluminum tank which is cylindrical in shape having a flat bottom, the tank and bottom having a diameter, further using a boot having an inner bore substantially the same as the diameter of the tank bottom, said boot normally attached on the tank bottom, and using a weight disk substantially the same diameter as the tank bottom, comprising the steps of:

removing the boot from the tank;

placing the weight disk between the boot and tank bottom; and trapping the weight disk between the boot and tank by replacing the boot onto the tank by inserting the tank bottom into the inner bore.

2. The method as recited in claim 1, wherein the step of placing the weight disk between the boot and tank bottom further comprises placing the weight disk inside the inner bore of the boot.

3. The method as recited in claim 2, wherein the boot further comprises a boot bottom and an inner lip extending inward in the inner bore just above the boot bottom, and wherein the step of placing the weight disk in the inner bore further comprises mounting the weight disk between the boot bottom and inner lip.

4. An aluminum tank buoyancy compensation system, for use on an aluminum tank having a flat bottom, comprising:

a boot, having:

an inner bore substantially the same diameter as the flat bottom;

a boot bottom;

a weight disk mounted against the boot bottom; and an inner lip positioned in the inner bore just above the boot bottom, the inner flange trapping the weight disk between the inner flange and boot bottom.

5. The aluminum tank buoyancy compensation system as recited in claim 4, wherein the weight disk is substantially the same diameter as the tank bottom.

6. The aluminum tank buoyancy compensation system as recited in claim 5, wherein the weight disk is made of lead and has a thickness between one thirty-second of an inch and one quarter inch.

* * * * *